US008761849B2

(12) United States Patent
Nakanishi et al.

(10) Patent No.: US 8,761,849 B2
(45) Date of Patent: Jun. 24, 2014

(54) SUPERCONDUCTIVE FILTER WITH PLURALITY OF RESONATOR PATTERNS FORMED ON SURFACE OF DIELECTRIC SUBSTRATE

(75) Inventors: Teru Nakanishi, Kawasaki (JP); Akihiko Akasegawa, Kawasaki (JP); Kazunori Yamanaka, Kawasaki (JP); Kazuaki Kurihara, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 777 days.

(21) Appl. No.: 12/606,719

(22) Filed: Oct. 27, 2009

(65) Prior Publication Data

US 2010/0105563 A1 Apr. 29, 2010

(30) Foreign Application Priority Data

Oct. 28, 2008 (JP) ..... 2008-276311

(51) Int. Cl.
*H01P 1/203* (2006.01)

(52) U.S. Cl.
CPC ..... *H01P 1/20381* (2013.01)
USPC ..... 505/210; 333/99 S

(58) Field of Classification Search
CPC ..... H01P 1/20381
USPC ..... 505/210; 333/99 S
See application file for complete search history.

(56) References Cited

U.S. PATENT DOCUMENTS

| | | | | |
|---|---|---|---|---|
| 5,948,165 | A | 9/1999 | Tamura | |
| 6,016,434 | A * | 1/2000 | Mizuno et al. | 505/210 |
| 7,132,691 | B1 | 11/2006 | Tanabe et al. | |
| 7,285,429 | B2 | 10/2007 | Shigaki et al. | |
| 7,650,174 | B2 | 1/2010 | Aoki et al. | |
| 2004/0189533 | A1 * | 9/2004 | Yamanaka et al. | 343/700 MS |
| 2005/0020452 | A1 * | 1/2005 | Nakanishi et al. | 505/100 |
| 2005/0029546 | A1 * | 2/2005 | Shigaki et al. | 257/200 |
| 2007/0229183 | A1 | 10/2007 | Akasegawa et al. | |
| 2007/0232499 | A1 * | 10/2007 | Ishii et al. | 505/210 |
| 2007/0277866 | A1 * | 12/2007 | Sander et al. | 136/230 |
| 2008/0061908 | A1 * | 3/2008 | Nakanishi et al. | 333/206 |

FOREIGN PATENT DOCUMENTS

| | | | |
|---|---|---|---|
| JP | 9-55420 | A | 2/1997 |
| JP | 10-135706 | A | 5/1998 |
| JP | 2006-101187 | A | 4/2006 |
| JP | 2006-352459 | A | 12/2006 |
| JP | 2007-274667 | A | 10/2007 |
| WO | WO-00-16411 | A1 | 3/2000 |
| WO | WO-2004-044982 | A1 | 5/2004 |

OTHER PUBLICATIONS

Japanese Office Action mailed Jul. 10, 2012 for corresponding Japanese Application No. 2008-276311, with Partial English-language Translation.

* cited by examiner

*Primary Examiner* — Paul Wartalowicz
(74) *Attorney, Agent, or Firm* — Fujitsu Patent Center

(57) ABSTRACT

A superconductive filter includes a superconductive filter substrate having a dielectric substrate and a plurality of resonator patterns formed on a surface of the dielectric substrate, the plurality of resonator patterns including a superconductive material; a package accommodating the superconductive filter substrate; and an intermediate substrate disposed between an inner surface of the package and the superconductive filter substrate, and thermally coupling the package and the superconductive filter substrate wherein a difference between a degree of contraction of the intermediate substrate and the degree of contraction of the dielectric substrate is smaller than a difference between the degree of contraction of the dielectric substrate and the degree of contraction of the package, when the package, the intermediate substrate, and the dielectric substrate are cooled from room temperature to a critical temperature of the resonator patterns.

12 Claims, 7 Drawing Sheets

FIG. 7

| | THERMAL EXPANSION COEFFICIENT ($\times 10^{-6}K^{-1}$) | | | | |
|---|---|---|---|---|---|
| TEMPERATURE RANGE | Cu | Al | KOVAR | MgO | In |
| 0 TO 100°C | 17.0 | 23.5 | | 10.0 | 23.5 |
| 150K | 13.0 | 17.0 | 6.0 TO 7.5 | 5.0 | |
| 70K | 7.0 | 7.0 | | 1.0 | |

SUPERCONDUCTIVE FILTER WITH PLURALITY OF RESONATOR PATTERNS FORMED ON SURFACE OF DIELECTRIC SUBSTRATE

CROSS-REFERENCE TO RELATED APPLICATIONS

This application is based upon and claims the benefit of priority of the prior Japanese Patent Application No. 2008-276311, filed on Oct. 28, 2008 the entire contents of which are incorporated herein by reference.

FIELD

The present invention relates to a superconductive filter which is usable in a superconductive state by cooling resonator patterns.

BACKGROUND

A high-speed and large-capacity transmission technique is necessary with the recent rapid increase in the demand for wireless communication. In order to realize size reduction and high performance of a filter, expectations have been raised due to the practical use of a microstrip line superconductor filter using a high-temperature superconductor as a wiring material. A superconductor has an extremely small surface electric resistance even in a high frequency region, such as microwave, as compared to a normal electrically good conductor. Therefore, when the superconductor is used in a filter with a plurality of resonator patterns arranged on a dielectric substrate, the increase in the transmission loss can be suppressed. In the filter arranged with the resonators, the greater the number of the resonators, the better the frequency cutoff characteristics, and frequency resources can be utilized effectively.

As the resonator, various patterns have been used, such as a hair-pin type, a disk type, and a ring type. In those resonator patterns, since the disk type resonator pattern and the ring type resonator pattern can suppress the localization of current as compared to the hair-pin type resonator pattern, they are advantageously highly resistant to voltage. However, when these patterns are stacked in many stages, the filter area is larger than that of the hair-pin type.

When the disk-type resonator pattern is used, a portion of the resonator pattern is cut to be resonated in a dual-mode, whereby the frequency cutoff characteristics per one stack of the resonator pattern can be further improved.

In addition, a method where a dielectric substrate (second dielectric substrate) is overlapped and disposed on the disk-type resonator pattern (resonator pattern formed on the surface of a first dielectric substrate), whereby current concentration can be reduced has been known. Further, a stress dispersing member and a pressure plate are disposed on the second dielectric substrate, and the second dielectric substrate and the resonator pattern are pressurized through the pressure plate, whereby the contact between the second dielectric substrate and the resonator pattern can be made uniform.

SUMMARY

According to one aspect of the invention, a superconductive filter includes a superconductive filter substrate having a dielectric substrate and a plurality of resonator patterns formed on a surface of the dielectric substrate, the plurality of resonator patterns including a superconductive material;

a package accommodating the superconductive filter substrate; and an intermediate substrate disposed between an inner surface of the package and the superconductive filter substrate, and thermally coupling the package and the superconductive filter substrate, wherein a difference between a degree of contraction of the intermediate substrate and the degree of contraction of the dielectric substrate is smaller than a difference between the degree of contraction of the dielectric substrate and the degree of contraction of the package, when the package, the intermediate substrate, and the dielectric substrate are cooled from room temperature to a critical temperature of the resonator patterns.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

BRIEF DESCRIPTION OF THE DRAWINGS

FIG. 7 is a diagram illustrating a thermal expansion coefficient of a filter material used in the embodiments.

DETAILED DESCRIPTION OF THE EMBODIMENTS

Hereinafter, a superconductive filter according to the present embodiment will be described.

In the operation of the superconductive filter, a resonator pattern formed of a superconductor is cooled to the critical temperature or lower, whereby the superconductive filter is placed in a superconductive state. A dielectric substrate with the resonator pattern formed thereon is accommodated in a metal package. In order to effectively cool the resonator pattern, the dielectric substrate is pressed against the package by, for example, a spring.

When the package is cooled, the package and the dielectric substrate are contracted. At this time, due to the difference in the degree of contraction between the material of the package and the material of the dielectric substrate, shear stress is applied to the dielectric substrate, and thus a crack may occur in the dielectric substrate.

When a disk pattern is resonated in a dual-mode, an input port and an output port are normally disposed in a position forming a central angle of 90° with each other. A case in which four stacked resonator patterns are combined and used is illustrated as follows. For example, in the first resonator pattern, an output port is disposed in a position rotated clockwise by 90° from the input port. In the second and third resonator patterns, the output port is disposed in a position rotated counterclockwise by 90° from the input port. According to this configuration, the fourth resonator pattern is disposed in a position adjacent to the first resonator pattern.

In order to suppress the electromagnetic coupling between the first resonator pattern and the fourth resonator pattern, a slit is provided in a dielectric substrate between these resonator patterns. An electroconductive member kept at the same potential as the ground electrode is inserted in the slit. When the slit is provided in the dielectric substrate, a crack may easily occur upon cooling.

Therefore, for example, an intermediate substrate or a flexible sheet is inserted between the superconductive filter substrate and the package. According to this configuration, the stress applied to the superconductive filter substrate due to the contraction of the package is reduced, whereby the occurrence of a crack in the superconductive filter substrate in the cooling may be suppressed.

Hereinafter, first to fourth embodiments will be described with reference to the drawings.

First Embodiment

Figure 1:
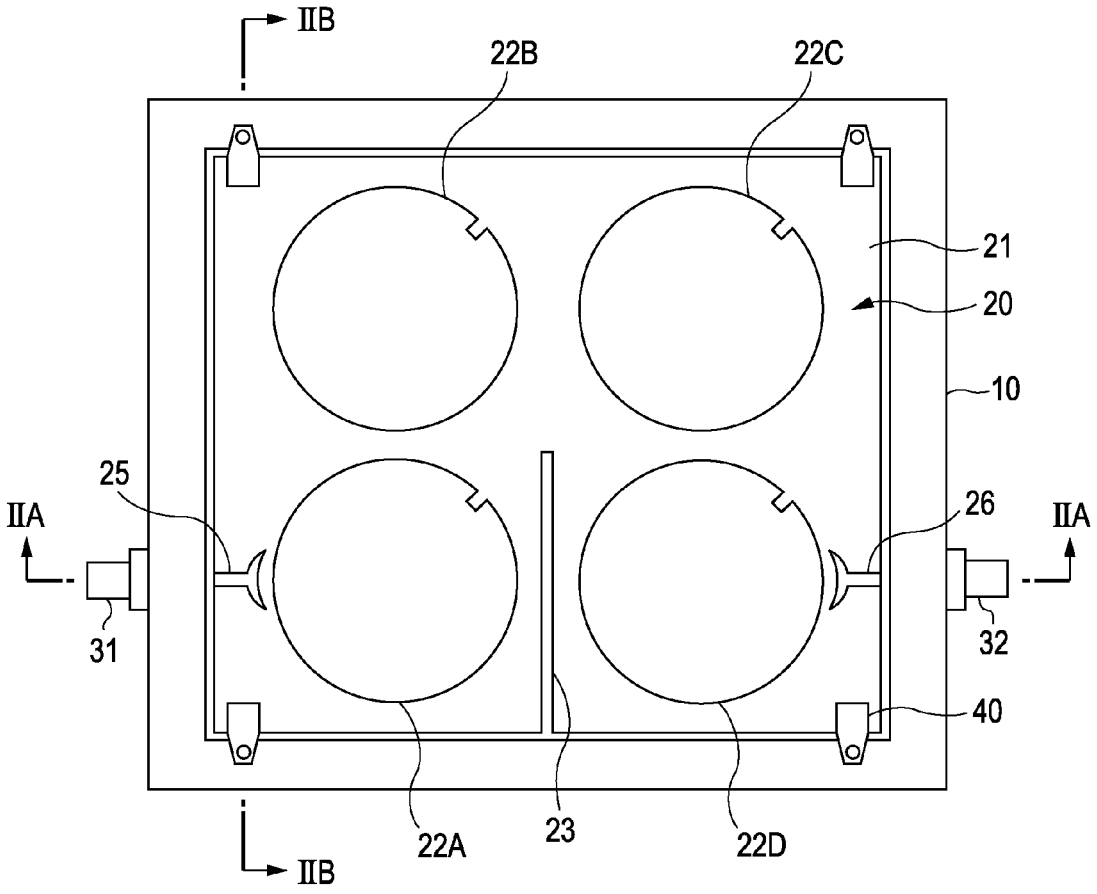
FIG. 1 is a plan view of a package and a superconductor filter substrate of a filter according to a first embodiment.

FIG. 1 is a plan view of a package and a superconductive filter substrate of a superconductive filter according to the first embodiment. A superconductive filter substrate 20 is accommodated in a package 10. The package 10 has a rectangular bottom surface and a side surface continuous to each side of the bottom surface. The superconductive filter substrate 20 has a substantially rectangular shape and is disposed on the bottom surface of the package 10.

The superconductive filter substrate 20 includes a dielectric substrate 21, first to fourth stacked resonator patterns (hereinafter referred to as first to fourth resonator patterns) 22A to 22D, an input feeder 25, and an output feeder 26. The first to fourth resonator patterns 22A to 22D, the input feeder 25, and the output feeder 26 are patterns composed of a superconductor formed on the surface of the dielectric substrate 21. The resonator patterns 22A to 22D each have a planar shape with a cutout provided in a portion of the outer circumference of the circular shape. The centers of the first to fourth resonator patterns 22A to 22D are disposed at positions corresponding to the four vertices of the rectangle.

In FIG. 1, the leftward azimuth is defined as 0°, and the clockwise direction is defined as the positive azimuth angle. The second resonator pattern 22B is disposed with a specific interval at azimuth 90° as viewed from the first resonator pattern 22A. The third resonator pattern 22C is disposed with a specific interval at azimuth 180° as viewed from the second resonator pattern 22B. The fourth resonator pattern 22D is disposed with a specific interval at azimuth 270° as viewed from the third resonator pattern 22C. The cutouts of the resonator patterns 22A to 22D are provided at azimuth 135° as viewed from the centers of the resonator patterns 22A to 22D.

The input feeder 25 is coupled to the first resonator pattern 22A at azimuth 0°. The output feeder 26 is coupled to the fourth resonator pattern 22D at azimuth 180°. The front ends on the resonator pattern side of the input feeder 25 and the output feeder 26 have a crescent shape corresponding to the outer circumferences of the resonator patterns 22A and 22D.

The first resonator pattern 22A and the second resonator pattern 22B are electromagnetically coupled to each other. Likewise, the second resonator pattern 22B and the third resonator pattern 22C are electromagnetically coupled to each other, and the third resonator pattern 22C and the fourth resonator pattern 22D are electromagnetically coupled to each other.

A slit 23 is provided between the first resonator pattern 22A and the fourth resonator pattern 22D and penetrates from the front surface side of the dielectric substrate 21 to the rear side surface. The slit 23 has a planar shape elongating in a direction perpendicular to a virtual straight line passing through the center of the first resonator pattern 22A and the center of the fourth resonator pattern 22D. An electroconductive bulkhead connected to a ground electrode is inserted into the slit 23 (to be described later with reference to FIG. 2A). Therefore, the electromagnetic coupling between the first resonator pattern 22A and the fourth resonator pattern 22D is weaker than the other electromagnetic couplings between the mutually adjacent resonator patterns 22A to 22D.

Therefore, a high-frequency signal is transmitted from the first resonator pattern 22A to the fourth resonator pattern 22D through the second and third resonator patterns 22B and 22C. The slit 23 has a function of preventing an electrical signal from being directly transmitted from the first resonator pattern 22A to the fourth resonator pattern 22D by diverting the electrical signal to the second resonator pattern 22B and the third resonator pattern 22C. It may also be considered that the second resonator pattern 22B and the third resonator pattern 22C serve as a diversion.

An input connector 31 and an output connector 32 are attached to the package 10. The input connector 31 and the output connector 32 are coaxial connectors. The inner conductor of the input connector 31 is connected to the input feeder 25, and the inner conductor of the output connector 32 is connected to the output feeder 26.

The dielectric substrate 21 is pressed against the bottom surface of the package 10 by hold-down springs 40 at positions corresponding to the four corners of the dielectric substrate 21.

Figure 2A:
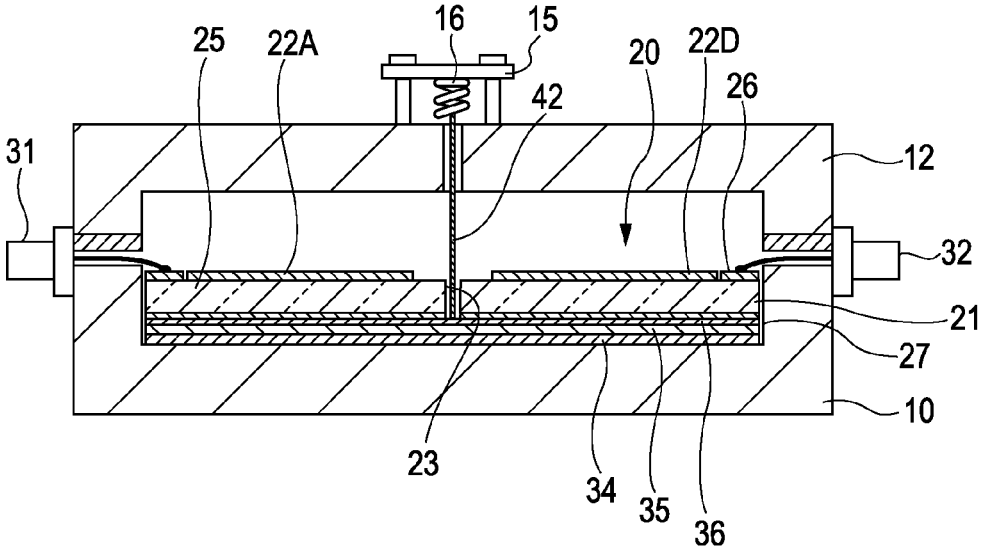
FIGS. 2A and 2B are cross-sectional views taken along dashed lines 2A-2A and 2B-2B of FIG. 1, respectively.
Figure 2B:
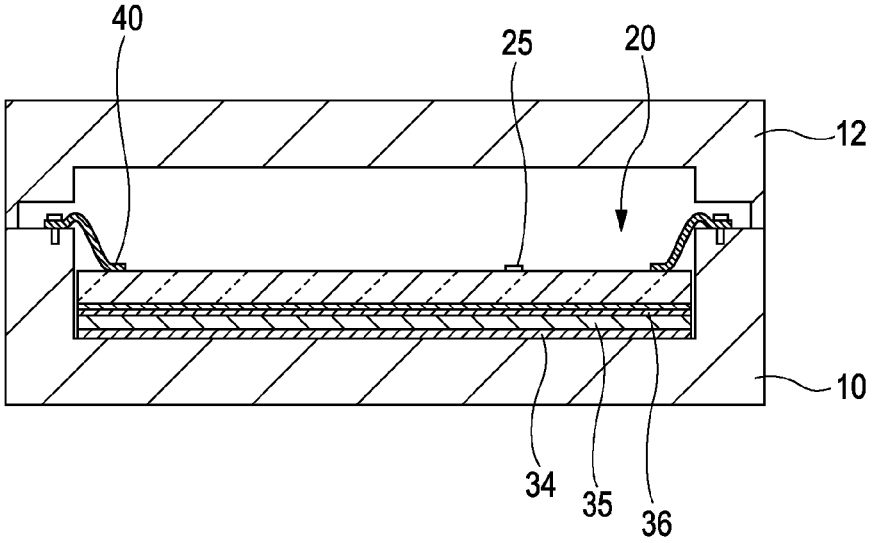

FIGS. 2A and 2B are cross-sectional views taken along dashed lines 2A-2A and 2B-2B, respectively, of FIG. 1. The superconductive filter substrate 20 is placed on the bottom surface of the package 10. The package 10 is formed of oxygen free copper with Ni and Au plated thereon. The superconductive filter substrate 20 includes the dielectric substrate 21. The dielectric substrate 21 is formed of MgO and has a thickness of 0.5 mm. Instead of MgO, the dielectric substrate 21 may be formed of a high-dielectric and low-loss dielectric material such as single crystal $LaAlO_3$, sapphire, or $CeO_2$.

The resonator patterns 22A and 22D, the input feeder 25, the output feeder 26, and the like are formed on the top surface of the dielectric substrate 21. A ground electrode 27 is formed on substantially the entire rear side surface of the dielectric substrate 21. The resonator patterns 22A and 22D, the input feeder 25, the output feeder 26, and the ground electrode 27 are formed of $YBa_2Cu_3O_{6+x}$ (YBCO) and have a thickness of 100 to 500 nm. Instead of YBCO, they may be formed of other oxide superconductors such as R—Ba—Cu—O based (R is Nb, Ym, Sm, or Ho) material, Bi—Sr—Ca—Cu—O based material, Pb—Bi—Sr—Ca—Cu—O based material, and $CuBa_pCa_qCu_rO_x$ based material ($1.5<p<2.5$, $2.5<q<3.5$, $3.5<r<4.5$).

A lower flexible sheet 34, an intermediate substrate 35, and an upper flexible sheet 36 stacked in this order are inserted in between the superconductive filter substrate 20 and the bottom surface of the package 10. The lower flexible sheet 34 and the upper flexible sheet 36 are formed of In and have a thickness of 0.1 mm. The intermediate substrate 35 is formed of kovar and has a thickness of 0.2 mm. The lower flexible sheet 34 and the upper flexible sheet 36 are softer than the package 10, the intermediate substrate 35, and the ground electrode 27.

The hold-down spring 40 presses the superconductive filter substrate 20 against the bottom surface of the package 10. A plate spring, for example, is used as the hold-down spring 40. The fixed end of the hold-down spring 40 is screw-fastened to the package 10, and the action end of the hold-down spring 40 is in contact with the upper surface of the dielectric substrate 21.

An opening in the upper portion of the package 10 is closed by a shield cover 12. The shield cover 12 is formed of oxygen free copper. A bulkhead 42 is inserted into the slit 23. The lower edge of the bulkhead 42 is in contact with the upper flexible sheet 36. The upper edge of the bulkhead 42 passes through a slit, provided in the shield cover 12, and penetrates to the outside of the shield cover 12. A hold-down spring 16 supported by a spring holding member 15 attached to the shield cover 12 presses the bulkhead 42 against the package 10.

Hereinafter, a process for producing the superconductive filter substrate 20 will be described. For example, a YBCO film is formed on the surface of a single crystal MgO substrate with a diameter of 2 inches by pulsed laser deposition. The YBCO film is patterned by using a photolithographic technique, whereby the resonator patterns 22A to 22D, the input feeder 25, and the output feeder 26 are formed. When the resonator patterns 22A to 22D are operated as 5 GHz resonators, each diameter is about 11 mm.

Next, the MgO substrate is cut into rectangular shapes of 46 mm×36.5 mm by using a dicing saw. An electrode in which a Cr film, a Pd film, and an Au film are stacked in this order is formed at the ends of the input feeder 25 and the output feeder 26 (the ends far from the resonator patterns 22A and 22D). The electrode may be formed by deposition and a liftoff method. The YBCO film is formed on the rear side surface of the dielectric substrate 21 by pulsed laser deposition. An Ag film is deposited on the surface of the YBCO film. In the formation of these metal films, sputtering and a thick-film printing method may be used instead of deposition.

The slit 23 is formed in the dielectric substrate 21. In the formation of the slit 23, an ultrasonic machining method, a laser beam machining method, and a sandblasting method may be used.

Figure 3:
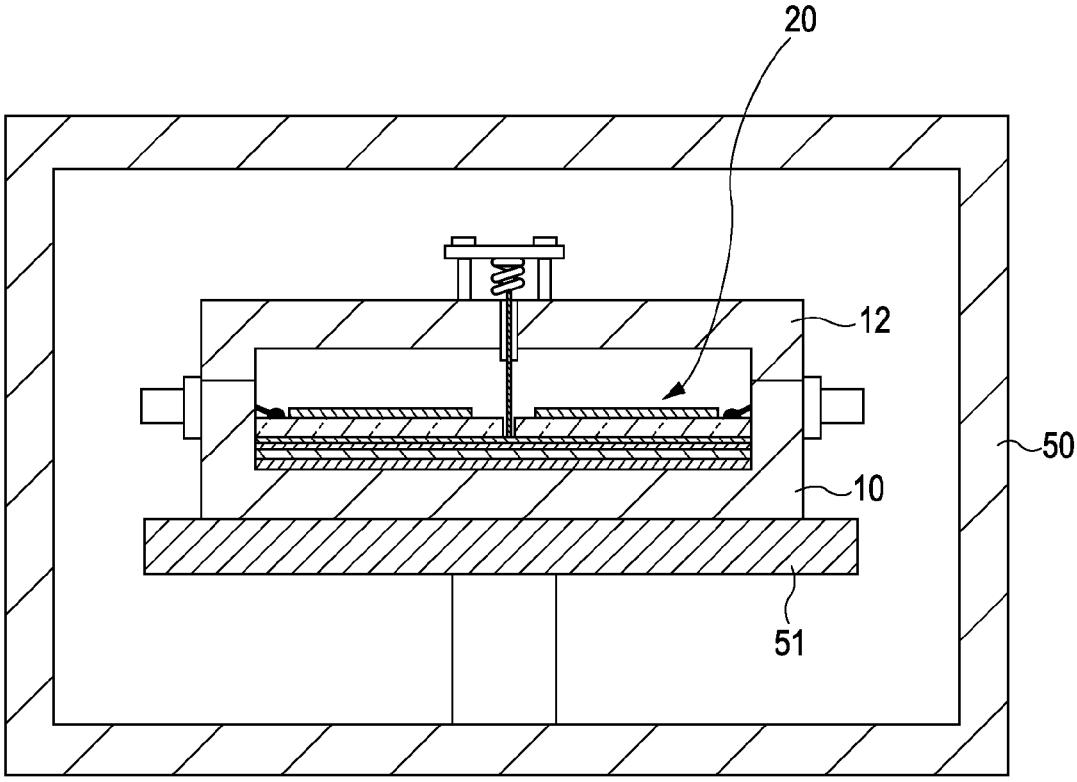
FIG. 3 is a schematic cross-sectional view of the filter of the first embodiment and a vacuum heat insulation vessel.

As illustrated in FIG. 3, the package 10 accommodating therein the superconductive filter substrate 20 is fixed to a cold plate 51 in a vacuum heat insulation vessel 50. In the operation, the vacuum heat insulation vessel 50 is vacuum-exhausted to 0.1 Pa, and the cold plate 51 is cooled to about 70 K.

The lower flexible sheet 34 and the upper flexible sheet 36 are deformed to follow a concavoconvex surface which is in contact with the sheets to thereby prevent the occurrence of a gap. According to this configuration, the superconductive filter substrate 20 may be efficiently cooled. The lower flexible sheet 34, the intermediate substrate 35, and the upper flexible sheet 36 are formed of an electroconductive material and have a function of electrically connecting the package 10 and the ground electrode 27.

When the resonator patterns 22A to 22D are cooled from room temperature to the critical temperature or lower (for example, about 70 K) at which the first resonator pattern 22A to 22D are placed in a superconductive state, the package 10, the shield cover 12, the dielectric substrate 21, the intermediate substrate 35, and the like are contracted. Since these materials are different in thermal expansion coefficient, the degrees of contraction are different from each other. "The degree of contraction" is defined as (L0−L1)/L0, wherein the length of the material before contraction in the stress free state is L0, and the length of the material after contraction is L1.

FIG. 7 illustrates the respective thermal expansion coefficients of Cu and Al used in the package 10, kovar used in the intermediate substrate 35, MgO used in the dielectric substrate 21, and In used in the flexible sheets 34 and 36.

When cooled from room temperature to the critical temperature, the degree of contraction of the package 10 is the largest, the degree of contraction of the superconductive filter substrate 20 is the smallest, and the degree of contraction of the intermediate substrate 35 is between the package 10 and the superconductive filter substrate 20. Based on the difference in the degree of contraction, shear stress in the direction of contracting in the in-plane direction is applied to the dielectric substrate 21. Since the intermediate substrate 35 having an intermediate contraction degree is inserted in between the package 10 and the dielectric substrate 21, the stress applied to the dielectric substrate 21 is reduced.

The thermal expansion coefficient in the range of 0 to 100° C. of In used in the lower flexible sheet 34 and the upper flexible sheet 36 is larger than the thermal expansion coefficient of Cu used in the package 10. Therefore, the difference in the thermal expansion coefficient between the upper flexible sheet 36 and the dielectric substrate 21 is larger than the difference in the thermal expansion coefficient between the package 10 and the dielectric substrate 21. However, since In is softer than the package 10, the intermediate substrate 35, and the dielectric substrate 21, the lower flexible sheet 34 and the upper flexible sheet 36 are easily distorted to follow the contraction of the surrounding members. Namely, the actual contraction degree of the lower flexible sheet 34 and the upper flexible sheet 36 hardly depends on the contraction degree inherent to the materials, but matches the contraction degrees of the surrounding materials. "The actual contraction degree" is defined by the ratio of the amount of contraction to the dimension before contraction when the lower flexible sheet 34 and the upper flexible sheet 36 receive stress from the surrounding materials. Thus, the contraction degree inherent to the materials of the lower flexible sheet 34 and the upper flexible sheet 36 do not have a big influence on the stress applied to the dielectric substrate 21.

Figure 4A:
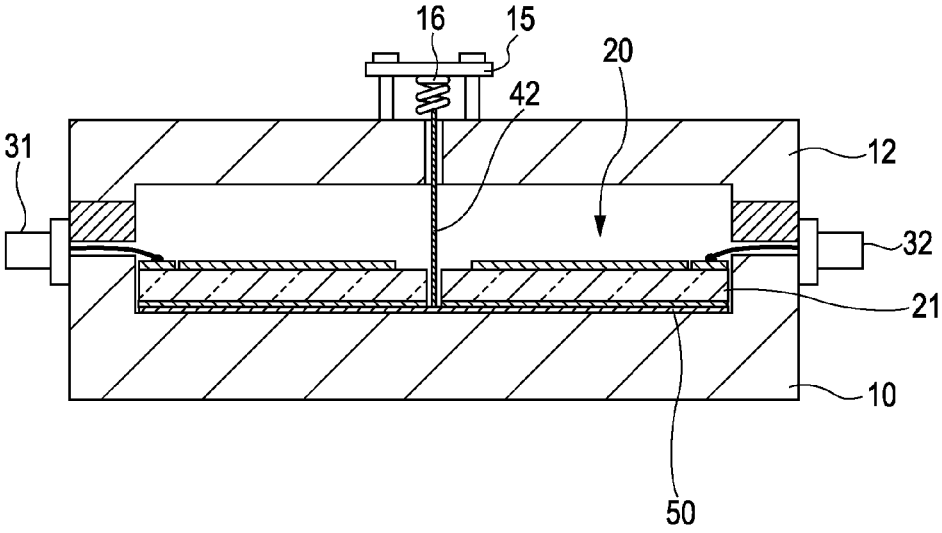
FIG. 4A is a cross-sectional view of a filter according to a reference example.

FIG. 4A is a cross-sectional view of a filter according to a comparative example. In the filter of the comparative example, only a flexible sheet 50 formed of In is disposed between the superconductive filter substrate 20 and the package 10, and a substrate equivalent to the intermediate substrate 35 of the first embodiment is not disposed.

Figure 4B:
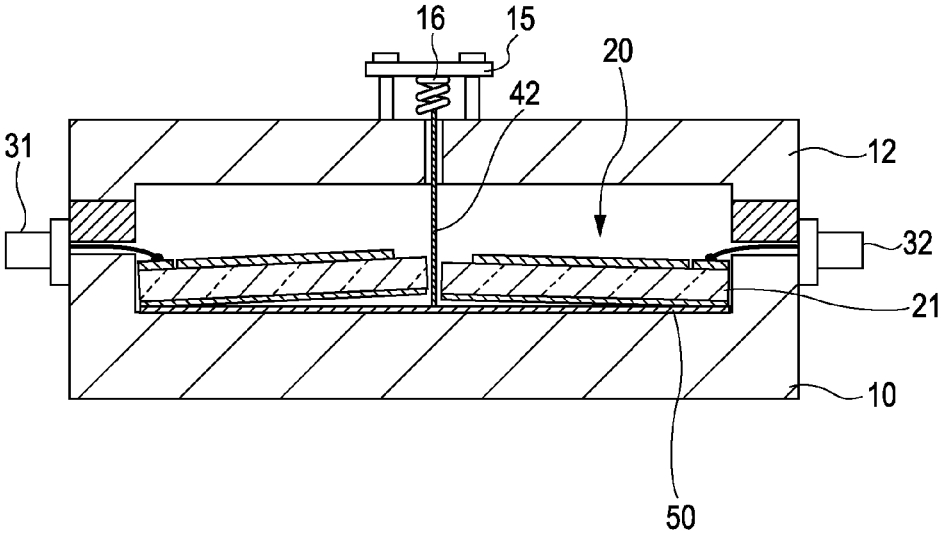
FIG. 4B is a cross-sectional view when the filter according to the reference example is cooled to the critical temperature.

FIG. 4B is a cross-sectional view of the filter cooled to the critical temperature. A crack beginning at the slit 23 occurs in the dielectric substrate 21, and the central portion of the dielectric substrate 21 is raised. This is because the dielectric substrate 21 is subjected to shear stress in the direction of contracting in the in-plane direction by the relatively large contraction of the package 10. In fact, when a plurality of samples were produced to be evaluated, the occurrence of the crack was confirmed in almost all samples.

Meanwhile, the crack does not occur in the filter of the first embodiment in which the intermediate substrate 35 is inserted. This is because the shear stress applied to the dielectric substrate 21 is reduced by the provision of the intermediate substrate 35. The occurrence of the crack in the dielectric substrate 21 may be reduced if not prevented by the insertion of the intermediate substrate 35.

In order to prevent the occurrence of the crack, the intermediate substrate 35 is preferably formed of a material whose contraction degree at the time when cooled from room temperature to the critical temperature of the superconductive material is close to the contraction degree of the dielectric substrate 21. For example, preferably a material having a contraction degree that is smaller than the contraction degree of the package 10 and not less than the contraction degree of the dielectric substrate 21 is used. Namely, the materials of the package, the intermediate substrate, and the dielectric substrate may be selected so that when cooled from room temperature to the critical temperature of the resonator patterns 22A to 22D, the difference between the contraction degree of the intermediate substrate 35 and the contraction degree of the dielectric substrate 21 is smaller than the difference between the contraction degree of the dielectric substrate 21 and the contraction degree of the package 10. When this condition is satisfied, a material having the contraction degree smaller than the contraction degree of the dielectric substrate 21 may be used for the intermediate substrate 35.

Second Embodiment

Figure 5:
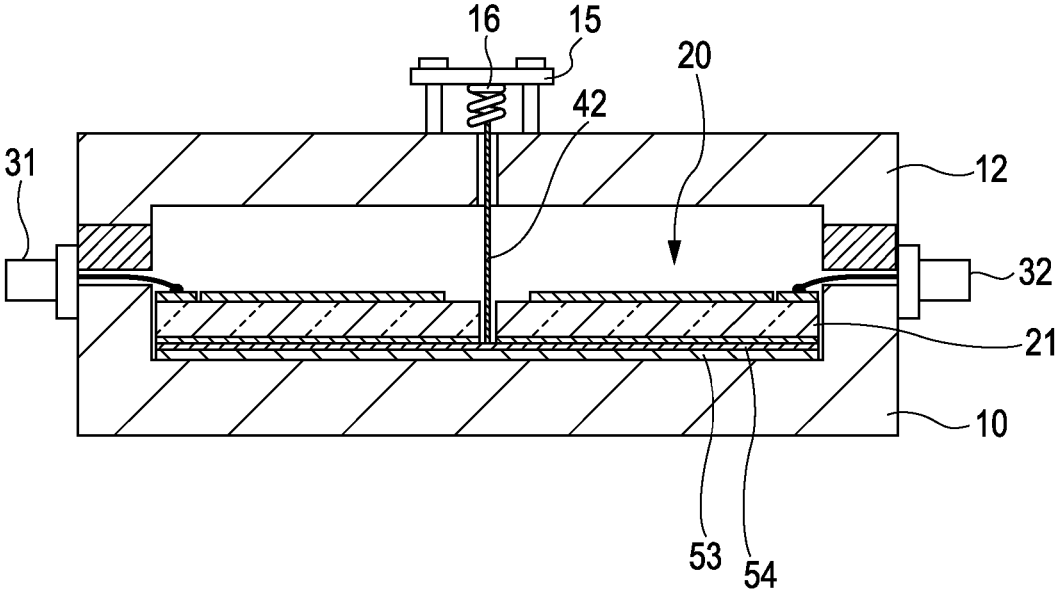
FIG. 5 is a cross-sectional view of a filter according to a second embodiment.

FIG. 5 is a cross-sectional view of a filter according to a second embodiment. Two flexible sheets 53 and 54 are overlapped and disposed between the package 10 and the superconductive filter substrate 20. The intermediate substrate 35 used in the filter of the first embodiment is not provided. The other configuration is the same as the configuration of the filter of the first embodiment. The flexible sheets 53 and 54 are formed of, for example, In.

In the second embodiment, when the package 10 is cooled to be contracted, sliding occurs in the interface between the two flexible sheets 53 and 54, and the transmission of the stress in the direction of the contracting of the dielectric substrate 21 in the in-plane direction is suppressed. Therefore, the occurrence of the crack in the dielectric substrate 21 may be suppressed.

Third Embodiment

Figure 6A:
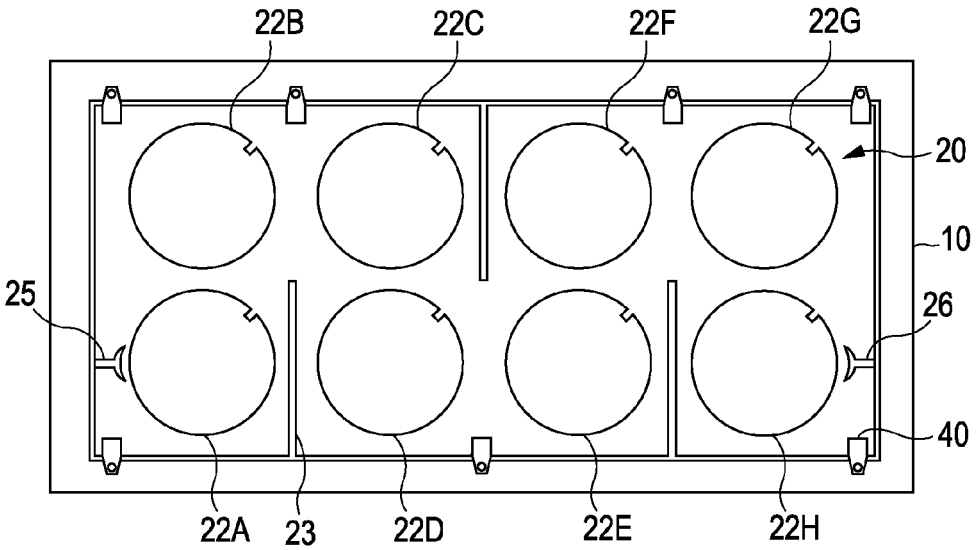
FIGS. 6A and 6B are plan views of a package and a superconductive filter substrate of the filter, respectively, according to a third embodiment and a fourth embodiment.

FIG. 6A is a plan view of the package 10 and the superconductive filter substrate 20 of the filter according to a third embodiment. In the first embodiment, the four resonator patterns 22A to 22D are cascade-connected; however, in the third embodiment, eight resonator patterns 22A to 22H are cascade-connected. The fourth resonator pattern 22D, the fifth resonator pattern 22E, and the eighth resonator pattern 22H are arranged in this order at azimuth 180° based on the first resonator pattern 22A. The second resonator pattern 22B, the third resonator pattern 22C, the sixth resonator pattern 22F, and the seventh resonator pattern 22G are arranged at azimuth 90° based on, respectively, the first resonator pattern 22A, the fourth resonator pattern 22D, the fifth resonator pattern 22E, and the eighth resonator pattern 22H.

The slits 23 are provided, respectively, between the first resonator pattern 22A and the fourth resonator pattern 22D, between the third resonator pattern 22C and the sixth resonator pattern 22F, and between the fifth resonator pattern 22E and the eighth resonator pattern 22H. As in the first embodiment illustrated in FIG. 2A, an electroconductive bulkhead is inserted into each of the slits 23. Although the resonator patterns are arranged adjacent to each other, the slit 23 is disposed between two resonator patterns undesired to be electromagnetically coupled.

As in the first embodiment illustrated in FIGS. 2A and 2B, the intermediate substrate 35 is disposed between the package 10 and the superconductive filter substrate 20. As in the second embodiment illustrated in FIG. 5, at least the two flexible sheets 53 and 54 are provided. Even when the plurality of slits 23 are formed in the dielectric substrate 21, the intermediate substrate 35 or at least the two flexible sheets 53 and 54 are provided, whereby cracking may be prevented from occurring in the dielectric substrate 21 upon cooling.

Fourth Embodiment

Figure 6B:
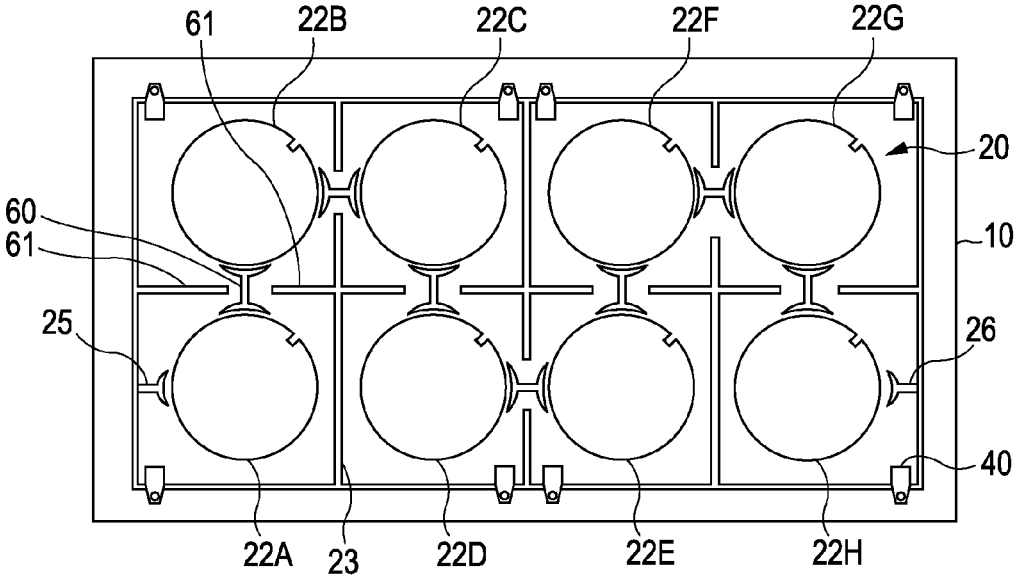

FIG. 6B is a plan view of the package 10 and the superconductive filter substrate 20 of the filter according to a fourth embodiment. The arrangement of the first to eighth resonator patterns 22A to 22H is the same as the arrangement in the third embodiment illustrated in FIG. 6A.

In the fourth embodiment, a connection line pattern 60 is disposed between the first resonator pattern 22A and the second resonator pattern 22B. Likewise, the connection line pattern 60 is provided between one resonator pattern and the next stacked resonator pattern. The connection line patterns 60 are formed of oxide superconductor as in the resonator patterns 22A to 22D.

Slits 61, respectively extending in the direction perpendicular to the connection line pattern 60, are provided on the both sides of the connection line pattern 60 for coupling the first resonator pattern 22A and the second resonator pattern 22B. The slit 61 extending in the direction at azimuth 180° is perpendicular to the slit 23 disposed between the first resonator pattern 22A and the fourth resonator pattern 22D. The slits 23 are provided in a similar manner on the both sides of the other connection line patterns 60. The electroconductive bulkheads are inserted into each of the slits 23.

The slits are disposed on both sides of the connection line pattern, and the electroconductive bulkheads are inserted into the slits, whereby an electrical signal may be concentrated on the connection line pattern.

As in the first embodiment illustrated in FIGS. 2A and 2B, the intermediate substrate 35 is disposed between the package 10 and the superconductive filter substrate 20. As in the second embodiment illustrated in FIG. 5, at least the two flexible sheets 53 and 54 are provided. Even when not simple linear slits but slits intersecting with each other are formed in the dielectric substrate 21, the intermediate substrate 35 or at least the two flexible sheets 53 and 54 are provided, whereby cracking may be prevented from occurring in the dielectric substrate 21 upon cooling.

In the first to fourth embodiments, a microstrip line structure where a ground electrode is disposed on only one side of the resonator pattern is used. The configuration of the first embodiment illustrated in FIGS. 2A and 2B in which the intermediate substrate 35 is disposed and the configuration of the second embodiment illustrated in FIG. 5 in which at least the two flexible sheets 53 and 54 are disposed may be used in the stripline structure in which the ground electrodes are disposed on the both sides of the resonator pattern.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present inventions have been described in detail, it should be understood that the various changes, substitutions, and alterations could be made hereto without departing from the spirit and scope of the invention.

What is claimed is:

1. A superconductive filter comprising:

a superconductive filter substrate having a dielectric substrate and a plurality of resonator patterns formed on a surface of the dielectric substrate, the plurality of resonator patterns including a superconductive material;

a package accommodating the superconductive filter substrate; and an intermediate substrate disposed between an inner surface of the package and the superconductive filter substrate, and thermally coupling the package and the superconductive filter substrate, wherein a difference between a degree of contraction of the intermediate substrate and the degree of contraction of the dielectric substrate is smaller than a difference between the degree of contraction of the dielectric substrate and the degree of contraction of the package, when the package, the intermediate substrate, and the dielectric substrate are cooled from room temperature to a critical temperature of the resonator patterns, wherein the superconductive filter substrate has a slit penetrating from one surface of the superconductive filter substrate to another surface of the superconductive filter substrate.

2. The superconductive filter according to claim 1, further comprising:

sheets formed of an indium material which are inserted between the intermediate substrate and the package and between the intermediate substrate and the superconductive filter substrate respectively.

3. The superconductive filter according to claim 2, wherein the superconductive filter substrate has a ground electrode formed on the rear side surface of the dielectric substrate, and the ground electrode is electrically connected to the intermediate substrate.

4. The superconductive filter according to claim 2, further comprising a pressing mechanism which presses the superconductive filter substrate and the intermediate substrate against an inner surface of the package.

5. The superconductive filter according to claim 2, wherein the superconductive filter substrate has a ground electrode formed on the rear side surface of the dielectric substrate, and one of the sheets is inserted between the intermediate substrate and a ground electrode.

6. The superconductive filter according to claim 1, wherein the package and the intermediate substrate are formed of an electroconductive material, and the intermediate substrate is electrically connected to the package, and the superconductive filter further comprises an electroconductive bulkhead inserted into the slit, and the electroconductive bulkhead is electrically connected to the intermediate substrate.

7. The superconductive filter according to claim 1, wherein the resonator pattern includes a first pattern disposed on one side of the slit, a second pattern disposed on another side of the slit, and a diversion pattern which allows a high-frequency signal to be transmitted from the first pattern to the second pattern by bypassing the slit.

8. A superconductive filter comprising:

a superconductive filter substrate having a dielectric substrate and a plurality of resonator patterns formed on a surface of the dielectric substrate, the plurality of resonator patterns including a superconductive material;

a package accommodating the superconductive filter substrate;

flexible sheets formed of an indium material, disposed between an inner surface of the package and the superconductive filter substrate respectively, and thermally coupling the package and the superconductive filter substrate; and an intermediate substrate disposed between the flexible sheets, wherein the superconductive filter substrate has a slit penetrating from one surface of the superconductive filter substrate to another surface of the superconductive filter substrate.

9. The superconductive filter according to claim 8, wherein the superconductive filter substrate has a ground electrode formed on a rear side surface of the dielectric substrate.

10. The superconductive filter according to claim 8, further comprising a pressing mechanism which presses the superconductive filter substrate against an inner surface of the package.

11. The superconductive filter according to claim 8, wherein the package and the flexible sheet are formed of an electroconductive material, and the flexible sheet is electrically connected to the package material, and the superconductive filter further comprises an electroconductive bulkhead inserted into the slit, and the electroconductive bulkhead is electrically connected to the flexible sheet.

12. The superconductive filter according to claim 8, wherein the resonator pattern includes a first pattern disposed on one side of the slit, a second pattern disposed on another side of the slit, and a diversion pattern which allows a high-frequency signal to be transmitted from the first pattern to the second pattern by bypassing the slit.

* * * * *